US010851543B2

(12) United States Patent
Grisolia

(10) Patent No.: US 10,851,543 B2
(45) Date of Patent: Dec. 1, 2020

(54) MINERAL WOOL WALL SYSTEM

(71) Applicant: IBACOS, Inc., Pittsburgh, PA (US)

(72) Inventor: Anthony Grisolia, West Leechburg, PA (US)

(73) Assignee: IBACOS, Inc., Pittsburgh, PA (US)

( * ) Notice: Subject to any disclaimer, the term of this patent is extended or adjusted under 35 U.S.C. 154(b) by 0 days.

(21) Appl. No.: 15/190,671

(22) Filed: Jun. 23, 2016

(65) Prior Publication Data

US 2016/0376787 A1 Dec. 29, 2016

Related U.S. Application Data

(60) Provisional application No. 62/185,075, filed on Jun. 26, 2015.

(51) Int. Cl.

| | |
|---|---|
| ***E04B 2/38*** | (2006.01) |
| ***E04H 1/00*** | (2006.01) |
| ***E02D 27/02*** | (2006.01) |
| ***E04B 2/70*** | (2006.01) |
| ***E04B 1/26*** | (2006.01) |
| ***E04B 1/94*** | (2006.01) |
| ***E04B 1/76*** | (2006.01) |

(52) U.S. Cl.

CPC ..... *E04B 2/38* (2013.01); *E02D 27/02* (2013.01); *E04B 1/26* (2013.01); *E04B 2/707* (2013.01); *E04H 1/00* (2013.01); *E04B 1/7604* (2013.01); *E04B 1/947* (2013.01)

(58) Field of Classification Search

CPC ... E04B 2/38; E04B 2/707; E04B 1/26; E04B 1/7604; E04B 1/947; E04H 1/00; E02D 27/02

See application file for complete search history.

(56) References Cited

U.S. PATENT DOCUMENTS 1,955,515 A * 4/1934 Reed ..... E04B 2/10 52/591.5
2,359,845 A * 10/1944 Harshberger ..... E04F 13/147 52/314
4,098,044 A * 7/1978 Slavik ..... E04B 1/7069 52/302.1
4,147,004 A * 4/1979 Day ..... E04C 2/243 52/309.11
4,306,396 A * 12/1981 Iotti ..... E04B 2/7411 52/238.1

(Continued)

FOREIGN PATENT DOCUMENTS

EP 2913454 A1 * 9/2015 ..... E04B 1/90

*Primary Examiner* — Basil S Katcheves
*Assistant Examiner* — Omar F Hijaz
(74) *Attorney, Agent, or Firm* — The Webb Law Firm

(57) ABSTRACT

A wall system for a building having a first room and a second room is provided. The wall system includes: (a) a first panel having a first batting material positioned between a first board and a second board; and (b) a second panel having a second batting material positioned between a third board and a fourth board. Further, at least one of the second board and the fourth board is formed from at least one mineral wool board. A building having a first floor, a foundation, and a first floor board area positioned between the first floor and the foundation is also provided. The first floor of the building includes a first room, a second room, and a wall system positioned between the first room and the second room.

10 Claims, 11 Drawing Sheets

(56) References Cited

U.S. PATENT DOCUMENTS

| | | | | |
|---|---|---|---|---|
| 5,301,487 | A * | 4/1994 | Wiebe | E04B 1/26 52/742.12 |
| 5,655,350 | A * | 8/1997 | Patton | E04B 1/7604 52/404.1 |
| 6,209,282 | B1 * | 4/2001 | Lafrance | E04B 2/707 52/481.1 |
| 6,662,516 | B2 * | 12/2003 | Vandehey | E04G 23/0218 52/309.5 |
| 7,007,434 | B1 * | 3/2006 | Danielsson | E04C 2/04 52/330 |
| 2008/0245030 | A1 * | 10/2008 | Sieber | E04B 2/707 52/782.1 |
| 2009/0107064 | A1 * | 4/2009 | Bowman | E04B 1/26 52/238.1 |
| 2011/0056163 | A1 * | 3/2011 | Kure | E04B 1/942 52/741.3 |
| 2014/0075872 | A1 * | 3/2014 | Mercado | E04B 2/58 52/309.9 |
| 2015/0093535 | A1 * | 4/2015 | Lambach | E04C 2/386 428/71 |

* cited by examiner

MINERAL WOOL WALL SYSTEM

CROSS REFERENCE TO RELATED APPLICATION

This application claims the benefit of U.S. Provisional Application No. 62/185,075, filed Jun. 26, 2015, which is incorporated herein by reference in its entirety.

BACKGROUND OF THE INVENTION

Field of the Invention

The present invention relates to partitions for buildings, and, particularly, party walls having a mineral wool barrier that provides improved fire and sound protection in buildings.

Description of Related Art

Buildings typically contain wall partitions that act as a divider between different rooms or areas in the building. Such partitions are particularly important in multi-unit buildings to divide different units disposed side-by-side. Adjacent units, therefore, share a wall that acts as a dividing partition. These walls are commonly referred to as party walls. In accordance with current building codes, party walls must possess a degree of fire resistance to prevent multiple units from catching fire if a fire is started in one of the units. In addition, party walls are also required to provide a degree of sound resistance. In order to meet these requirements, current party walls are made with gypsum wall panels, typically a panel of gypsum plaster sandwiched between two sheets of heavy paper, also referred to as dry wall.

Typically, party walls are incorporated into each unit during construction of the multi-unit building. As a result, party walls are often exposed to water and/or moisture. However, current party walls, such as party walls made with gypsum wall panels, are easily damaged due to exposure to water and/or moisture. In addition, current party walls also allow a significant amount of air to leak through, thereby reducing the energy efficiency of the building. Thus, it is desirable to provide improved party walls that do not absorb or deteriorate from water/moisture, that reduce the amount of air flow, and which also possess the required fire and sound resistant properties.

SUMMARY OF THE INVENTION

The present invention is generally directed to a wall system for a building.

In certain non-limiting embodiments, the wall system of the present invention includes: (a) a first panel comprising a first batting material positioned between a first board and a second board, the first board facing an interior of a first room of the building; and (b) a second panel comprising a second batting material positioned between a third board and a fourth board, the third board facing an interior of a second room in the building and the fourth board facing the second board of the first panel. Further, at least one of the second board and the fourth board comprises at least one mineral wool board.

In certain non-limiting embodiments, the second board and the fourth board both comprise mineral wool boards. In another non-limiting embodiment, at least one of the second board and the fourth board independently comprise two or more mineral wool boards. The mineral wool boards of the second board and/or the fourth board can comprise a binder and inorganic fibers. In some non-limiting embodiments, the inorganic fibers are derived from stone, slag, glass, or a combination thereof.

Moreover, in some non-limiting embodiments, the first board and third board comprise a drywall/gypsum board, a mineral wool board, or a combination thereof. In another non-limiting embodiment, at least one of the first batting material and the second batting material comprises mineral wool fibers.

As previously described, the wall system comprises a first panel and a second panel. In certain non-limiting embodiments, a gap is located between the first panel and the second panel. An additional mineral wool board can be positioned within a portion of the gap.

In certain non-limiting embodiments, the first panel and second panel further comprise studs embedded within the first batting material and the second batting material. The first board, second board, third board, and fourth board can be attached to the studs.

In one non-limiting embodiment, at least the first panel comprises a first wood sheet positioned between the first batting material and the second board. In another non-limiting embodiment, the first panel further comprises a second wood sheet positioned on a side of the second board opposite the first wood sheet. The wood sheet can also comprise a fire-resistant coating layer. For example, the wood sheet can have a fire-resistant coating layer that comprises a binder comprising inorganic materials.

The present invention is also directed to a building comprising a first floor, a foundation, and a first floor board area positioned between the first floor and the foundation. Further, the first floor comprises a first wall system comprising: (a) a first panel comprising a first batting material positioned between a first board and a second board, the first board facing an interior of a first room in the building; and (b) a fourth panel comprising a second batting material positioned between a third board and a second board, the third board facing an interior of a second room in the building and the fourth board facing the second board of the first panel. In accordance with one non-limiting embodiment of the present invention, at least one of the second board and the fourth board comprises at least one mineral wool board. Further, the second board and the fourth board can extend through the first floor board area to the foundation of the building.

As previously described, the wall system comprises a first panel and a second panel. In certain non-limiting embodiments, a gap is located between the first panel and the second panel. Moreover, the first panel and second panel can further comprise studs embedded within the first batting material and the second batting material, and the first board, second board, third board, and fourth board are attached to the studs.

In certain non-limiting embodiments, at least the first panel comprises a first wood sheet positioned between the first batting material and the second board. In such embodiments, the first wood sheet and the second board extend through the first floor board area to the foundation of the building. In another non-limiting embodiment, the first panel further comprises a second wood sheet positioned on a side of the second board opposite the first wood sheet, and the first wood sheet, the second board, and the second wood sheet extend through the first floor board area to the foundation of the building.

The building can also include additional floors. For instance, the building can further comprise a second floor and a second floor board area positioned between the first floor and the second floor. In such embodiments, the second board and the fourth board can extend through the second floor board area to the second floor of the building. The second floor can also comprise a second wall system that is the same as the first wall system.

In another non-limiting embodiment, the building further includes an attic comprising a plurality of trusses with an additional mineral wool board attached to at least one side of each truss. In some non-limiting embodiments, a first wood sheet is positioned between each truss and the additional mineral wool board. In another non-limiting embodiment, a second wood sheet is positioned on a side of the additional mineral wool board opposite the first wood sheet.

DESCRIPTION OF THE INVENTION

Figure 1:
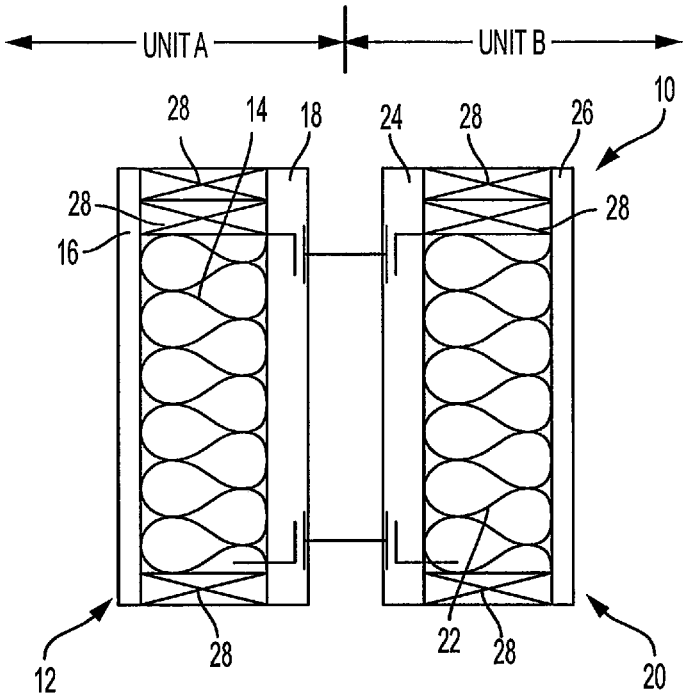
FIG. 1 PRIOR ART
FIG. 1 is a schematic front view of a party wall according to the prior art.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

As indicated, the present invention is directed to a wall system 100 (shown in FIGS. 3 and 4), which can be used in a building. The term "building", as used herein, refers to a structure with at least a floor, a roof, and a plurality of walls. Further, the term "building" encompasses single unit residential and commercial buildings as well as multi-unit residential and commercial buildings such as, for example, multi-unit apartment complexes, multi-unit townhouses, and row houses.

The wall system 100 of the present invention is particularly useful as a partition for buildings. As used herein, the term "partition" refers to a wall or barrier that divides rooms or units of a building. In some non-limiting embodiments, the wall system 100 of the present invention is used as a party wall. A "party wall" refers to a division between separate units within a multi-unit building that are designed to at least provide a degree of fire and sound protection between adjacent units. Party walls are typically used in multi-unit apartment complexes, multi-unit townhouses, row houses, and the like.

Figure 2:
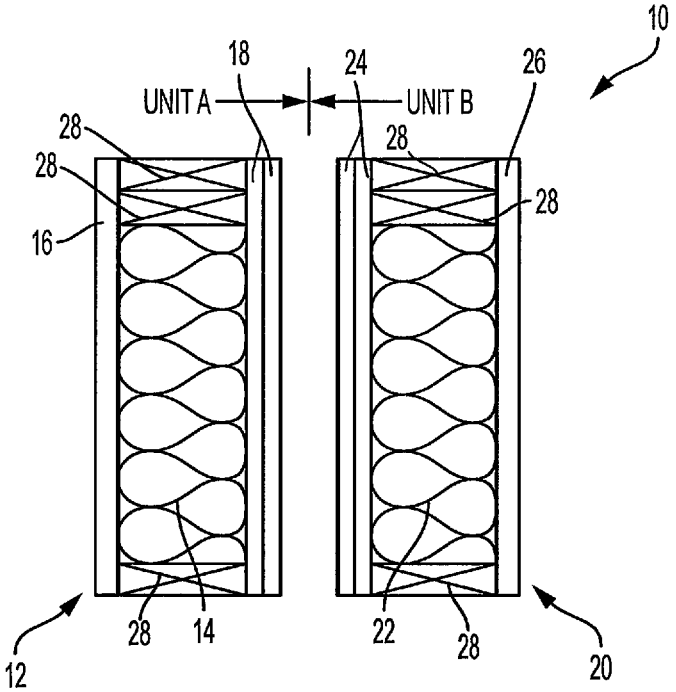
FIG. 2 PRIOR ART
FIG. 2 is another schematic front view of a party wall according to the prior art.

A wall partition currently known in the art, and which is commonly used as a party wall, is shown in FIGS. 1 and 2. Referring to FIGS. 1 and 2, a wall partition or party wall 10 used in a multi-unit building typically includes a first panel 12 comprising a first batting material 14 composed of, for example, mineral wool fibers, positioned between a first gypsum and/or drywall board 16 and a second gypsum and/or drywall board 18. The first drywall board 16 can face the interior of at least one of the units (unit A), while the second drywall board 18 can face a second panel 20 of the party wall 10. As further shown in FIGS. 1 and 2, the second panel 20 includes a second batting material 22 positioned between a third drywall board 24 and a fourth drywall board 26. The fourth drywall board 26 can face the interior of a second unit (unit B), while the third drywall board 24 can face the first panel 12 of the party wall 10, with the panels 12, 20 being sandwiched by structural components 28 of the buildings, such as a stud (e.g., a 2×4 board), joists, floor boards, and the like, typically made from lumber. The drywall boards 16, 18, 24, 26 can include single boards, two-layer glass faced boards, and the like. Further, the first and second panels 12, 20 are typically held in place with clips, channels, and similar fasteners.

As previously noted, drywall boards 16, 18, 24, 26 used in current party walls 10 are easily damaged due to exposure to water and/or moisture. To overcome these drawbacks, the present invention provides an improved wall system 100 (shown in FIGS. 3 and 4) that at least comprises mineral wool boards. As used herein, "mineral wool" refers to inorganic fibers derived from mineral materials. Non-limiting examples of mineral materials that can be used to form the inorganic fibers include rock or stone such as basalt (a volcanic rock), slag, glass, and combinations thereof. As used herein, "slag" refers to the by-product produced when a metal is separated or smelted from its raw ore.

The mineral wool boards used with the present invention can also include a binder. As used herein, a "binder" can refer to organic materials that can form a matrix and which can help hold the inorganic fibers together. The binders used in the mineral wool boards can comprise polymeric materials. The term "polymer" includes homopolymers, copolymers, and oligomers. Further, as used herein, the term "resin" is used interchangeably with the term "polymer". Non-limiting examples of suitable polymeric materials include polyurethanes, polyureas, polyamines, polyesters, polyamides, and combinations thereof. In certain non-limiting embodiments, the binder is a thermosetting binder. The term "thermosetting binder" refers to a binder that comprises resins or polymers that "set" irreversibly upon curing or crosslinking in which the polymer chains are joined together by covalent bonds. Typically, thermosetting binders also include a crosslinking agent. A "crosslinking agent" refers to a compound with two or more reactive functional groups that are capable of forming a linkage between two or more polymers. In another non-limiting embodiment, the binder is a thermoplastic-based binder which, in contrast to a thermosetting binder, includes polymeric materials that may be repeatedly heated to a softened or molten state and returned to their former state upon cooling. Suitable mineral wool boards are also commercially available from Roxul, Inc. under the tradename COMFORTBOARD™.

Figure 3:
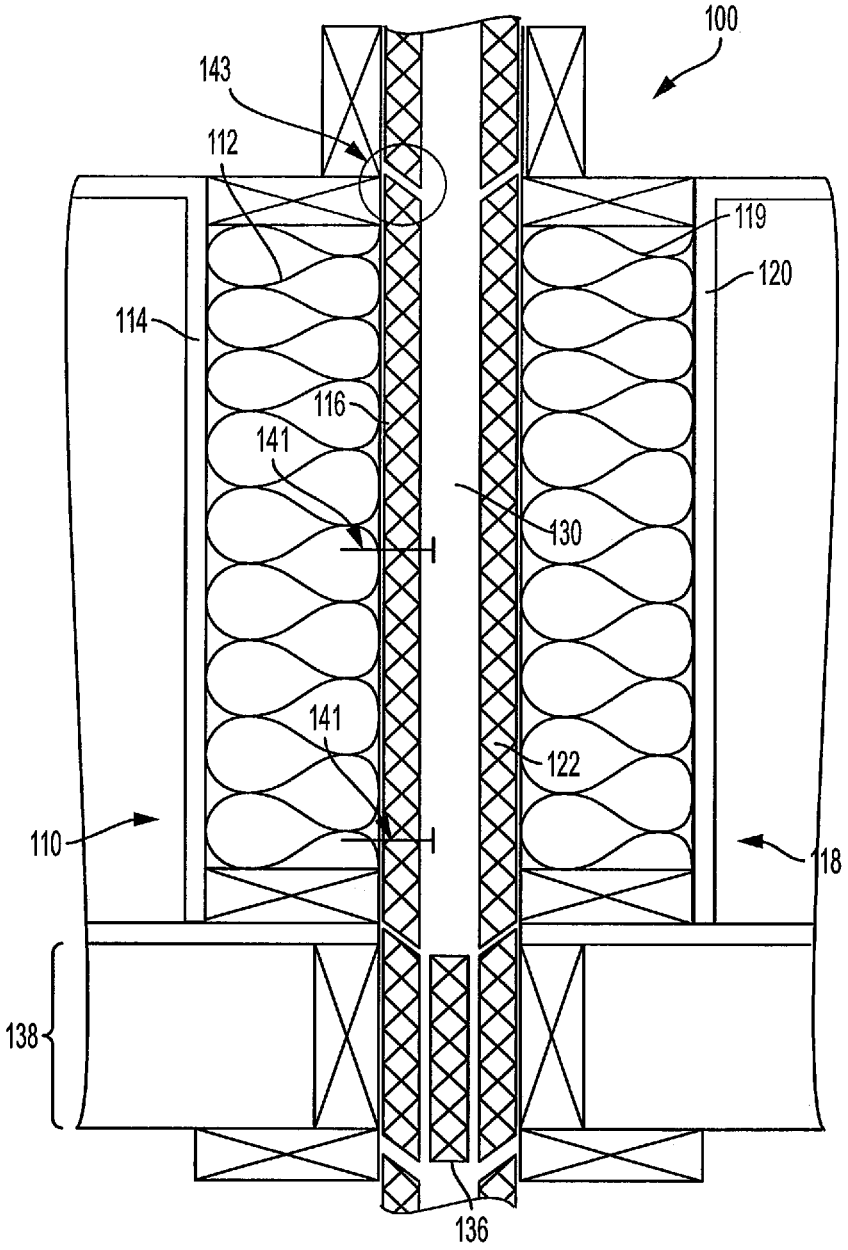
FIG. 3 is a schematic partial cross-sectional view of a wall system according to the present invention.

As shown in FIG. 3, the wall system 100 according to the present invention can include a first panel 110 having a batting material 112 positioned between a first board 114 and a second board 116. The first board 114, which is configured to face in the direction of the interior of a first room, such as the interior of a room in a first unit of a multi-unit building, can comprise a drywall board, a mineral wool board, or a combination thereof. The second board 116, which is configured to face the opposite direction from the first board 114, comprises a mineral wool board. As used herein, by being "configured to face" a particular direction in a building should be understood to mean that the component (e.g., the panel 110 or board 114) has a structure suitable for facing in the identified orientation.

As indicated, the first panel 110 can include a batting material 112. As used herein, "batting material" can refer to a material made of an assembly of non-woven fibers or foam. The batting material 112 can comprise, but is not limited to, cotton, polyester, wool, mineral wool, and combinations thereof. The batting material 112 can also include a binder such as any of the binders previously described. Mineral wool batting materials are generally less dense and less rigid than mineral wool boards. Suitable mineral wool batting materials are also commercially available from Roxul, Inc. under the tradename COMFORTBATT®.

The wall system 100 can also include a second panel 118. The second panel 118 can be made of the same components as the first panel 110. Alternatively, the second panel 118 can be made of one or more different components. In certain non-limiting embodiments, the second panel 118 comprises a batting material 119 positioned between a third board 120 and a fourth board 122. The third board 120, which is configured to face in the direction of the interior of a second room, such as the interior of a room in a second unit of a multi-unit building, can comprise a drywall board, a mineral wool board, or a combination thereof. The fourth board 122, which is configured to face the first panel 110 of the wall system 100, comprises a mineral wool board. There can also be a space or gap 130 between the first panel 110 and the second panel 118. An additional mineral wool board 136 can be placed in at least a portion of the gap 130, such as in the area of the floor boards 138, to prevent fire from spreading to additional floors in a multi-level building. As used herein, by being "configured to" face a direction in a building should be understood to mean that the component has a structure suitable therefor.

Figure 4:
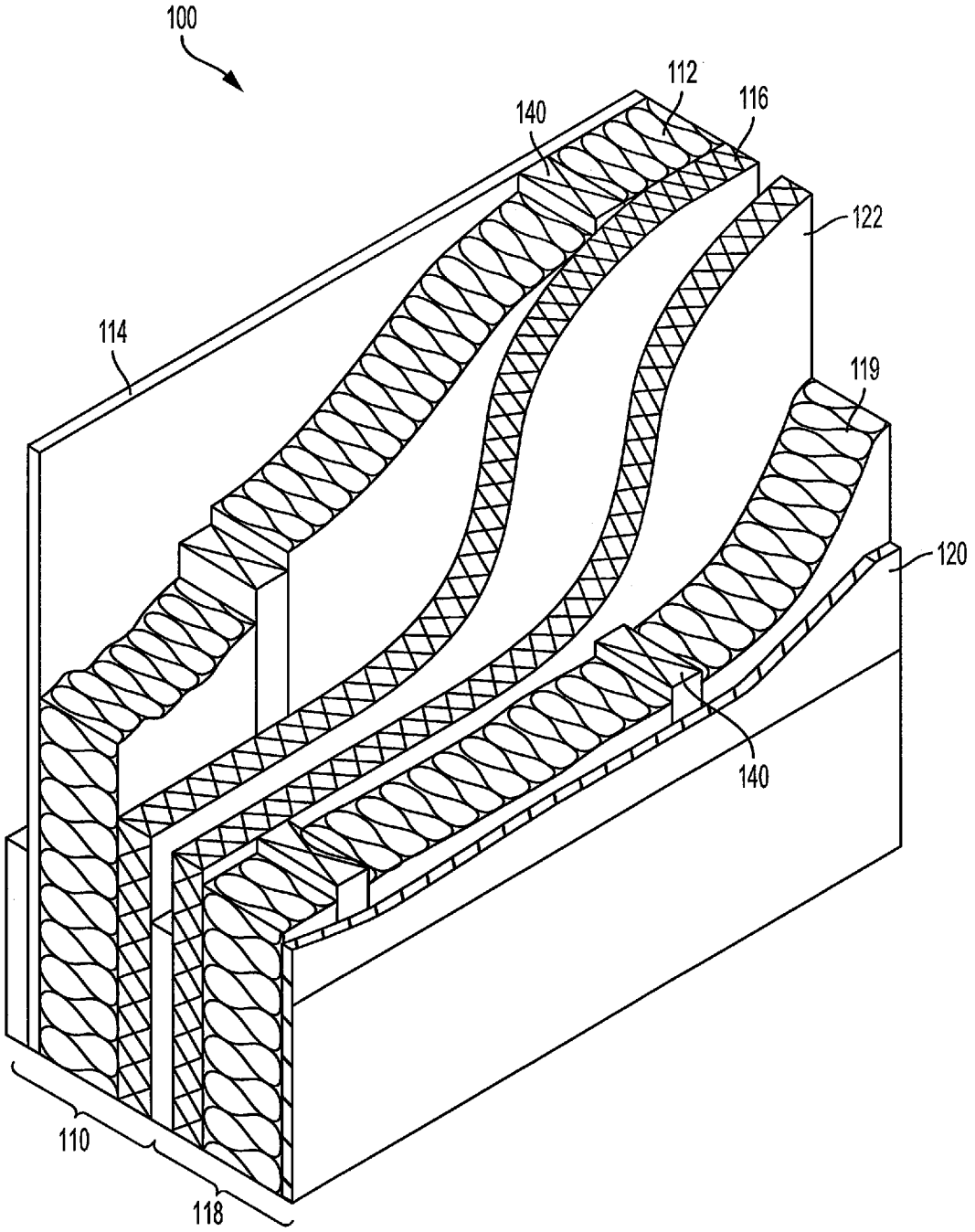
FIG. 4 is a perspective cross-sectional view of a wall system according to the present invention.

FIG. 4 illustrates a perspective cross-sectional view of the previously described wall system 100. Particularly, FIG. 4 illustrates the wall system 100 with a first panel 110 having a batting material 112, such as a mineral wool batting material, that is positioned between a first board 114 that is a drywall board and a second board 116 that is a mineral wool board. As further illustrated in FIG. 4, the wall system 100 includes a second panel 118 having a batting material 119, such as a mineral wool batting material, that is positioned between a third board 120 that is a drywall board and a fourth board 122 that is a mineral wool board.

As further shown in FIG. 4, studs 140 can be positioned adjacent to the batting material 112, 119. For instance, one or more studs 140 can be embedded within the batting material 112, 119 of the panel 110, 118 and can extend vertically through at least a portion of a building to provide structural support. During construction of the wall system 100, the first board 114, second board 116, third board 120, and fourth board 122 can be attached to the studs 140 used in the framing of the wall system 100 such as with fasteners 141 (shown in FIG. 3). The fasteners 141 can include, but are not limited to, screws, nails, adhesives, and the like.

Figure 5:
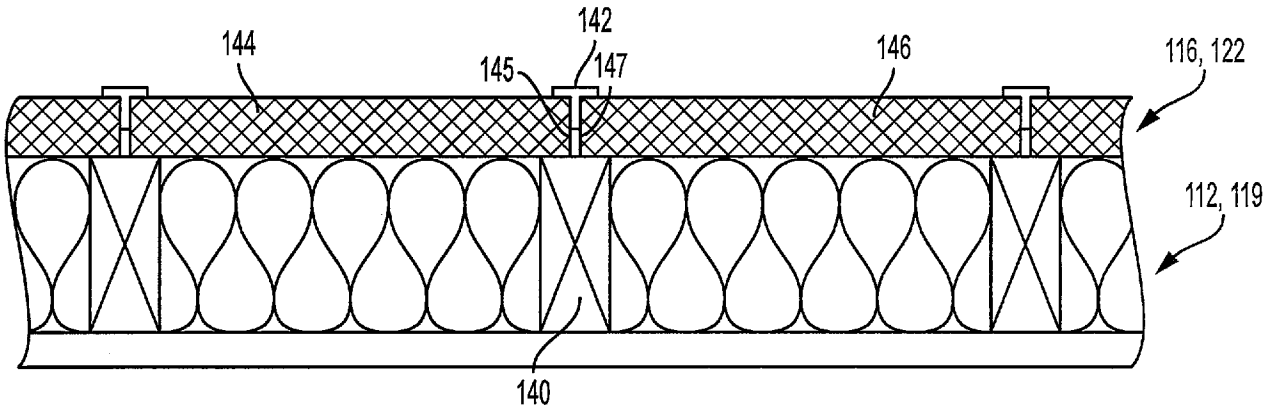
FIG. 5 is a schematic partial cross-sectional view of a panel with multiple mineral wool boards according to the present invention.

In certain non-limiting embodiments, the second board 116 of the first panel 110 and the fourth board 122 of the second panel 118 are independently formed from multiple mineral wool boards. Referring to FIG. 5, in some instances, the second board 116 of the first panel 110 and/or the fourth board 122 of the second panel 118 can be formed from multiple pieces, sections, or segments of mineral wool boards 144, 146. Different boards 144, 146 can be joined or connected together at a stud 140, as shown in FIG. 5. Particularly, and as shown in FIG. 5, one end 145 of a first mineral wall board 144 can be attached to a portion of a stud 140 and one end 147 of a second mineral wall board 146 can be attached to another portion of the stud 140. This arrangement can be used to attach multiple mineral wall boards 144, 146 consecutively along a horizontal or vertical direction of a room or area of a building to form a portion of the first panel 110 or the second panel 118.

The ends 145 and 147 of the consecutively placed mineral wool boards 144 and 146 can be aligned directly next to each other to form a continuous barrier of mineral wool boards 144 and 146. In certain non-limiting embodiments, the ends 145 and 147 of the consecutively placed mineral wool boards 144 and 146 are cut at an angle 143 (see FIG. 3) to join the ends 145 and 147 together. Alternatively, the ends 145 and 147 of the consecutively placed mineral wool boards 144 and 146 can be configured to allow for a lapping connection such as a shiplap connection, as is known in the art. At the lapped configuration, the ends 145 and 147 of consecutively placed mineral wool boards 144 and 146 can be directly adjacent to each other to form a continuous fire- and sound-resistance barrier.

As further shown in FIG. 5, a joint treatment 142 can be placed between the ends 145, 147 of the consecutive mineral wool boards 144, 146 to form a seal between the mineral wool boards 144, 146. Non-limiting examples of suitable joint treatments 142 include, but are not limited to, cementitious materials, fire rated spray foam, and combinations thereof.

Figure 6:
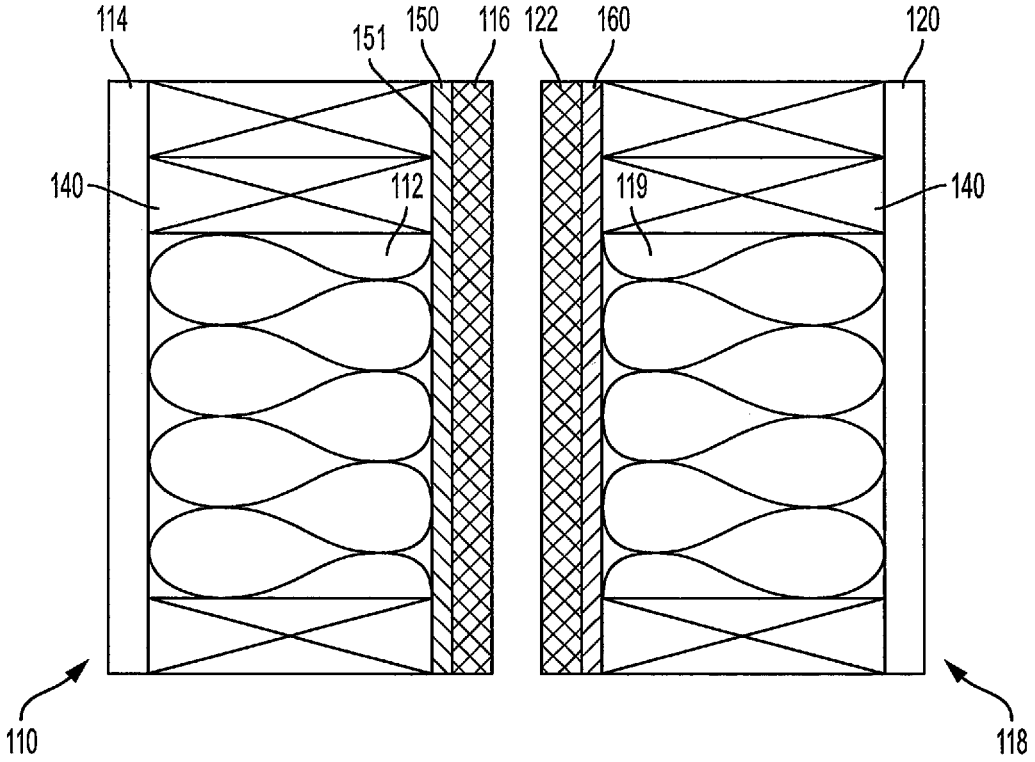
FIG. 6 is a schematic partial cross-sectional view of a wall system with wood sheets according to the present invention.

The batting materials 112, 119, and boards 114, 116, 120, 122 of the first panel 110 and second panel 118 can be positioned directly next to each other in the previously described arrangements without any intervening components or layers. Alternatively, in certain non-limiting embodiments, the first panel 110 and/or the second panel 118 include additional components and layers. For example, and as shown in FIG. 6, the first panel 110 can further include a wood sheet 150 positioned between the batting material 112 and the second board 116 that comprises a mineral wool board. Non-limiting examples of a wood sheet 150 include an oriented strand board or OSB and plywood. As used herein, "oriented strand board" or "OSB" refers to an engineered structural-use board typically manufactured from thin wood strands bonded together with resin under heat and pressure.

The wood sheet 150 can also have a fire-resistant coating layer 151 formed over at least a portion of one side of the wood sheet 150. The fire-resistant coating layer 151 can be formed from a binder component comprising inorganic materials. Non-limiting examples of inorganic materials include magnesium oxide, alumina calcium, aluminate cement, and combinations thereof. The fire-resistant coating layer 151 can also comprise a gauging component that comprises, but is not limited to, an aqueous solution of magnesium chloride, magnesium sulfate, and combinations thereof. Suitable fire-resistant coatings are also described in U.S. Pat. Nos. 4,572,862; 4,818,595; and 5,039,454, which are incorporated herein by reference in their entireties. Suitable fire-resistant coatings are also commercially available from International Barrier Technology, Inc. under the tradenames PYROTITE® and BLAZEGUARD®.

As indicated, the fire-resistant coating layer 151 can be applied over at least a portion of one side of the wood sheet 150. The fire-resistant coating layer 151 can also be applied over an entire side of the wood sheet 150. In some non-limiting embodiments, the fire-resistant coating layer 151 is applied over at least a portion of both sides of the wood sheet 150 or, alternatively, over the entirety of both sides of the wood sheet 150.

Figure 7:
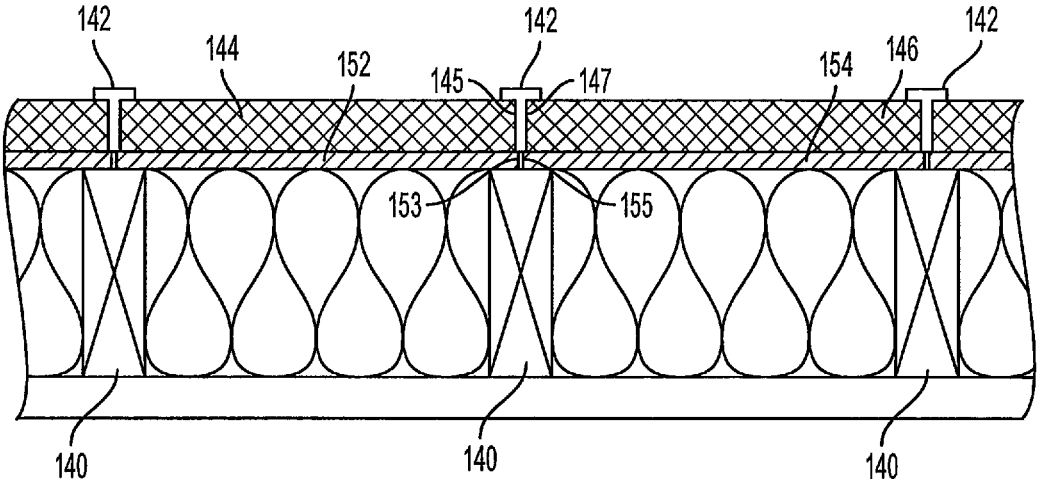
FIG. 7 is a schematic partial cross-sectional view of a panel with multiple mineral wool boards and multiple wood sheets according to the present invention.

Referring to FIG. 7, two separate wood sheets 152 and 154 can be attached to the same stud 140 that extends vertically in a room of a building. Particularly, and as shown in FIG. 7, one end 153 of a first wood sheet 152 can be attached to a portion of a stud 140 and one end 155 of a second wood sheet 154 can be attached to another portion of the stud 140. This arrangement can be used to attach multiple wood sheets 152, 154 consecutively along a horizontal or vertical direction of a room or area of a building.

The ends 153 and 155 of the consecutively placed wood sheets 152 and 154 can be aligned directly next to each other to form a continuous barrier of wood sheets 152 and 154. A joint treatment 142 can be placed between the ends 153, 155 of the consecutive wood sheets 152, 154 to form a seal between the wood sheets 152, 154. Non-limiting examples of suitable joint treatments include any of the joint treatments previously described.

In certain non-limiting embodiments, mineral wool boards 144, 146 are placed over the wood sheets 152, 154 such that two separate mineral wool boards 144, 146 are aligned over the same stud 140. For instance, and as shown in FIG. 7, two separate mineral wool boards 144, 146 can be positioned over two separate wood sheets 152, 154, respectively, such that one end 145 of a first mineral wool board 144 is aligned over a portion of the stud 140, and one end 147 of a second mineral wool board 146 is aligned over another portion of the stud 140. The end 145 of the first mineral wool board 144 and the end 147 of the second mineral wool board 146 can therefore be attached to the wood sheets 152, 154 as well as the stud 140. A joint treatment 142 can be placed between the ends 145, 147 of the consecutive mineral wool boards 144, 146 and between the ends 153, 155 of the consecutively placed wood sheets 152, 154.

With reference again to FIG. 6, as previously described, the first panel 110 can include the wood sheet 150 with the fire-resistant coating layer 151, positioned between the batting material 112 and the second board 116, which comprises a mineral wool board. In certain non-limiting embodiments, the wall system 100 also includes the second panel 118, which comprises the batting material 119 positioned between the third board 120, which comprise a drywall board, and the fourth board 122, which comprises a mineral wool board. As shown in FIG. 6, the second panel 118 further comprises a wood sheet 160 positioned between the batting material 119 and the fourth board 122 (e.g., the mineral wool board). The wood sheet 160 can include any of the wood sheets previously described, such as a fire-resistant coated OSB. Separate wood sheets 160 can also be used in the second panel 118 and aligned over the same stud 140 as previously described with respect to the first panel 110. Multiple mineral wool boards that can be used to form the fourth board 122 can be placed over the wood sheets 160 such that separate mineral wool boards are aligned over the same stud 140 as previously described.

Figure 8:
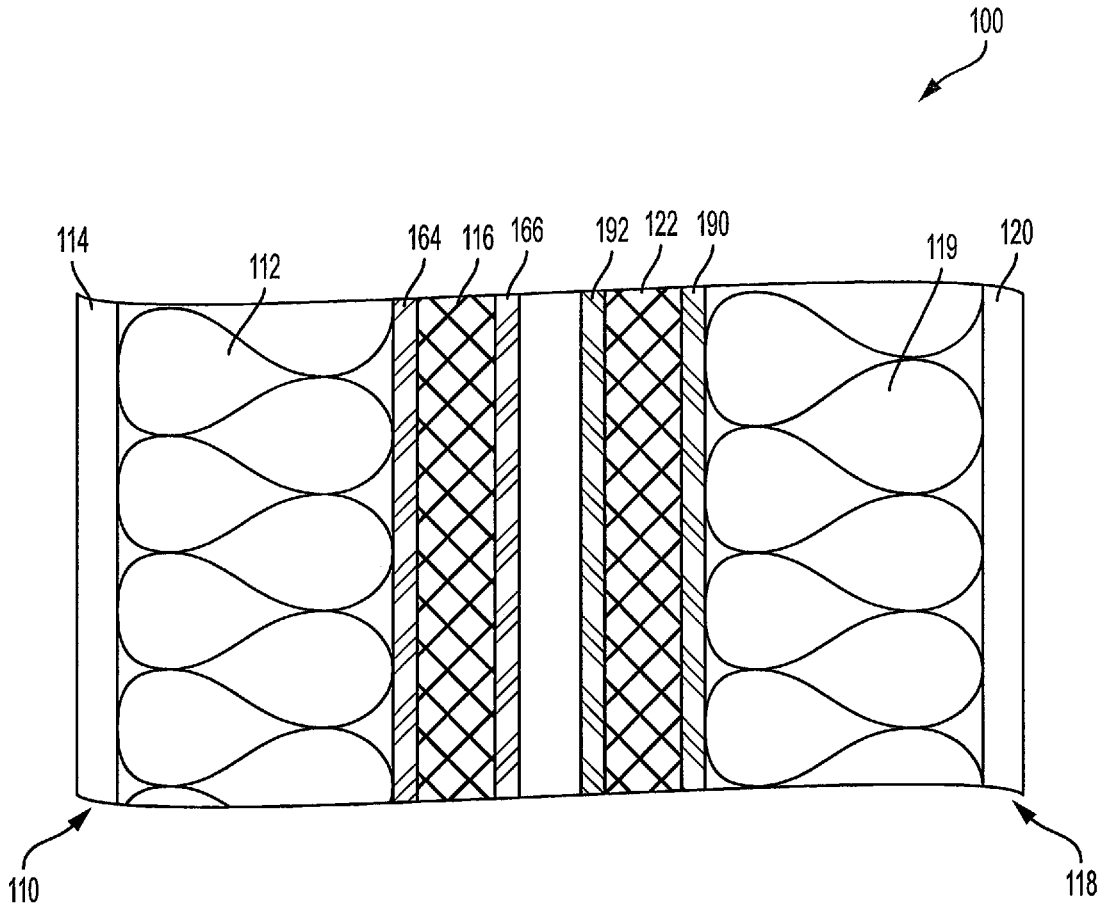
FIG. 8 is a schematic partial cross-sectional view of a wall system with different layers of wood sheets according to the present invention.

In certain non-limiting embodiments, at least one of the first panel 110 and the second panel 118 have at least two wood sheets positioned between different components of the first and/or second panel 110, 118. For example, and as shown in FIG. 8, the first panel 110 can include (i) a first wood sheet 164 positioned between the batting material 112 and the second board 116, and (ii) a second wood sheet 166 positioned on the opposite side of the second board 116. The first wood sheet 164 and the second wood sheet 166 can include any of the wood sheets previously described such as an OSB with a fire-resistant coating. Thus, in some non-limiting embodiments, the first panel 110 can include a first board 114 that comprises a drywall board, a batting material 112, a first wood sheet 164, a second board 116 that comprise a mineral wool board, and a second wood sheet 166 as shown in FIG. 8.

Figure 9:
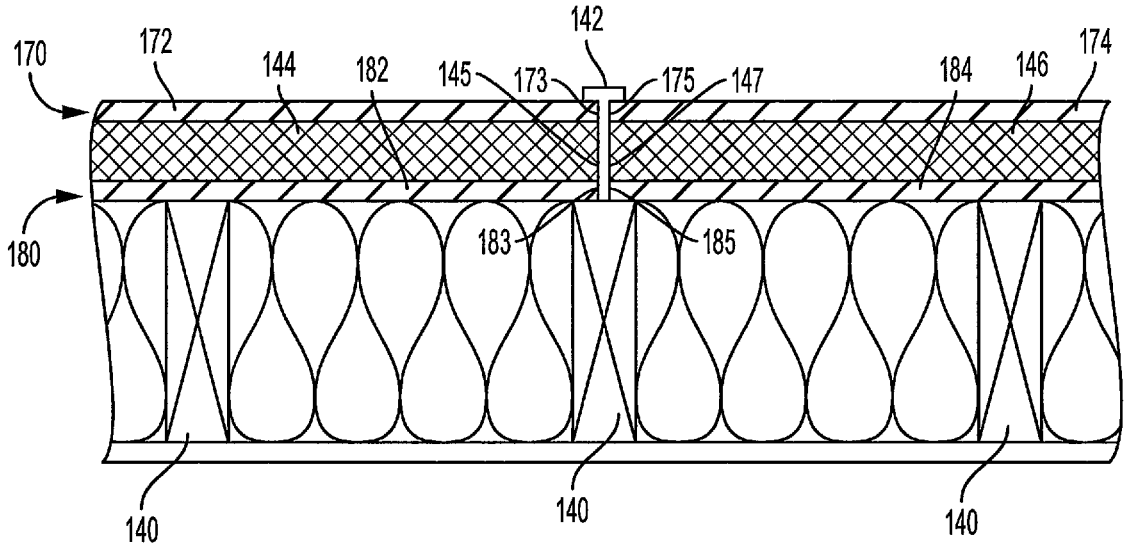
FIG. 9 is a schematic partial cross-sectional view of a panel with multiple mineral wool boards and different layers of multiple wood sheets according to the present invention.

In some non-limiting embodiments, as shown in FIG. 9, a first layer of wood sheets 170, which includes at least two separate wood sheets 172, 174, can be attached to the same stud 140, which extends vertically in a room of a building. For example, one end 173 of a first wood sheet 172 can be attached to a portion of a stud 140 and one end 175 of a second wood sheet 174 can be attached to another portion of the stud 140. Mineral wool boards 144, 146 are positioned adjacent to the wood sheets 172, 174, such that one end 145 of a first mineral wool board 144 is aligned over a portion of the stud 140 and one end 147 of a second mineral wool board 146 is aligned over another portion of the stud 140. A second layer of wood sheets 180, which includes at least two separate wood sheets 182, 184, are positioned adjacent to the mineral wool boards 144, 146, such that one end 183 of a third wood sheet 182 is aligned over a portion of the stud 140, and one end 185 of a fourth wood sheet 184 is aligned over another portion of the stud 140. The end 183 of the third wood sheet 182 and the end 185 of the fourth wood sheet 184 can therefore be attached to the mineral wool boards 144, 146. Optionally, the ends 183, 185 can also be attached to the first layer of wood sheets 170 and/or the stud 140. A joint treatment 142 can be placed between the ends 183 and 185 of the consecutively placed wood sheets 182 and 184, the ends 145 and 147 of the consecutively placed mineral wool boards 144 and 146, and/or the ends 173 and 175 of the consecutively placed wood sheets 172 and 174 for mounting the respective ends to the stud 140.

In certain non-limiting embodiments, referring again to FIG. 8, the second panel 118 of the wall system 100 also comprises at least two wood sheets 190, 192 as previously described with respect to the first panel 110. In particular, the second panel 118 can comprise (i) a first wood sheet wood sheet 190 positioned between the batting material 119 and the fourth board 122, and (ii) a second wood sheet 192 positioned on the opposite side of the fourth board 122. Multiple wood sheets 190, 192 can also be arranged over the same stud 140 as previously described with respect to the first panel 110.

It is appreciated that the first panel 110 and the second panel 118 can also include additional components and layers. For example, the first panel 110 and second panel 118 can each independently include an additional drywall board attached to the first board 114 and third board 120 that are drywall boards, thereby providing two layers of drywall boards on the first panel 110 and the second panel 118. Other additional components and layers can be added to the first panel 110 and second panel 118 based on the building structure and desired properties in the wall system 100.

The wall systems 100 of the present invention can also be prepared off-site at a wall panelization facility remote or away from a building construction site. As such, the wall systems 100 can be pre-formed at a manufacturing plant and shipped to a construction site where they can be directly installed.

Figure 10:
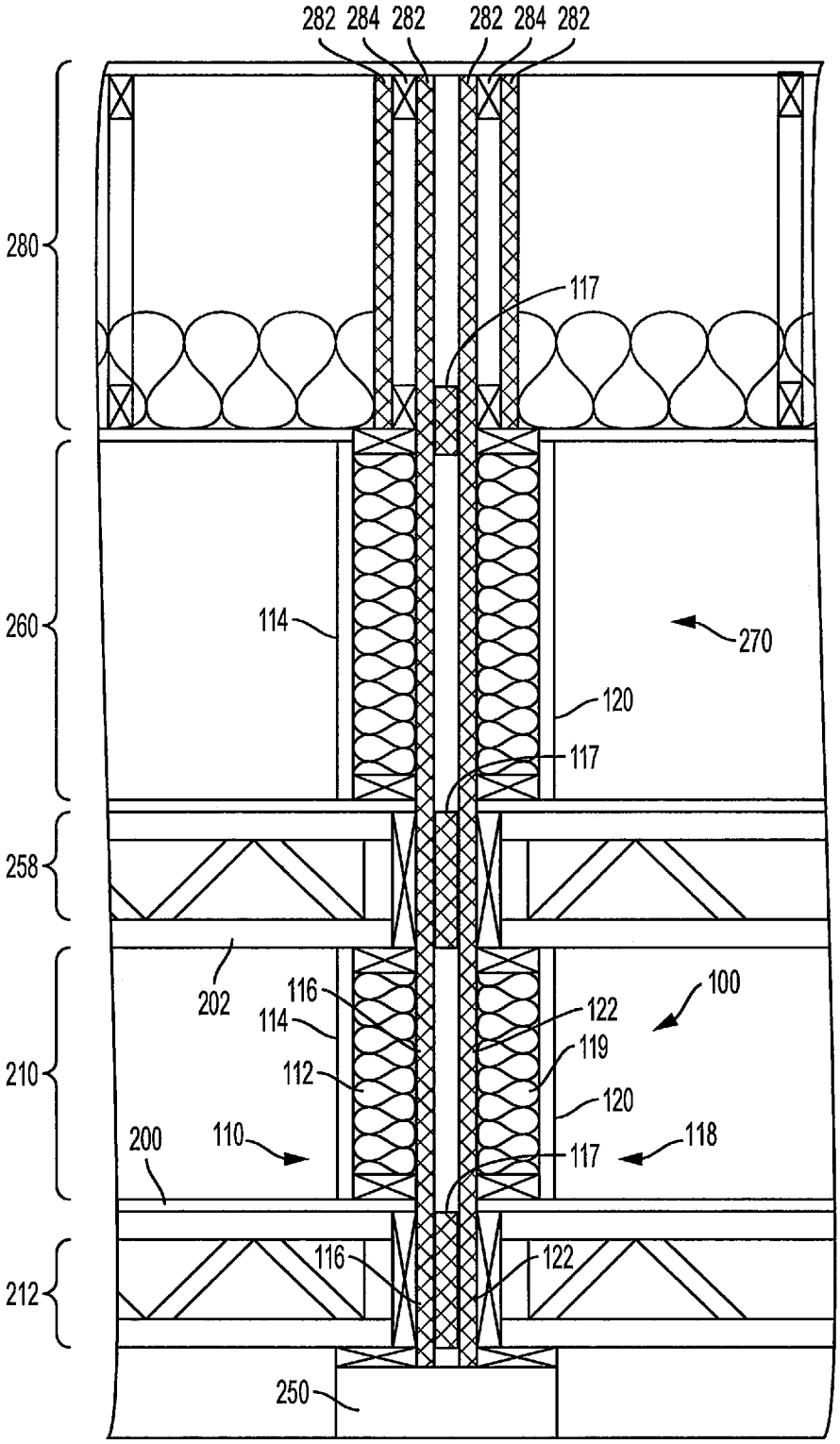
FIG. 10 is a schematic partial cross-sectional view of a building with a wall system that extends through different floors according to the present invention.

As indicated, the previously-described wall systems 100 can be used to form a wall partition in a building. For example, referring to FIG. 10, the wall system 100 can extend from a floor 200 to a ceiling 202 in at least one room, such as in the first level 210, of a building. In certain non-limiting embodiments, the second board 116 of the first panel 110 and/or the fourth board 122 of the second panel 118 can extend through a floor board area 212. For example, and as shown in FIG. 10, the second board 116 and the fourth board 122 can comprise mineral wool boards that extend through the floor board area 212 of a multi-level building. This arrangement provides fire and sound protection around the floor board areas 212 of the building. In some examples, an additional board 117, such as a mineral wool board, can be mounted between the second board 116 and the fourth board 122 in the floor board area 212 to provide an added fire protection barrier between the floor board area 212 and foundation 250.

In certain non-limiting embodiments, when the wall system 100 includes one or more of the previously described wood sheets 150, 160 (shown in FIG. 6), the wood sheets 150, 160 can also extend through the floor board area 212 of the building. For instance, the first panel 110 can include a wood sheet 150 and a second board 116 that comprises a mineral wool board. Both the wood sheet 150 and the second board 116 extend through a floor board area 212 of a multi-level building. The second panel 118 can also include a wood sheet 160 and a fourth board 122 that comprises a mineral wool board that extends through the floor board area 212 of the multi-level building. As such, the wall system 100 can include wood sheets 150, 160 and mineral wool boards 116, 122 that extend through the floor board area 212 of a building.

In another non-limiting embodiment, the first panel 110 and the second panel 118 of the wall system 100 both independently include two separate wood sheets 164, 166 and 190, 192 (shown in FIG. 8). In such embodiments, the second board 116 that comprises a mineral wool board and the two wood sheets 164, 166 of the first panel 110, and the fourth board 122 that comprises a mineral wool board and the two wood sheets 190, 192 of the second panel 118 can all extend through the floor board area 212 of a building. Thus, the wall system 100 can include multiple wood sheets 164, 166 and 190, 192 on each panel 110, 118 that extend through the floor board area 212 of a building along with the mineral wool boards.

As shown in FIG. 10, the second board 116, which comprises a mineral wool board, and the fourth board 122, which also comprises a mineral wool board, extend through the floor board area 212 to the foundation 250 of the building. In certain non-limiting embodiments, the first panel 110 and second panel 118 of the wall system 100 also include the wood sheets 150, 160 (shown in FIG. 6) or wood sheets 164, 166, 190, 192 (shown in FIG. 8), respectively, that extend through the floor board area 212 to the foundation 250 of the building. This arrangement provides a fire and sound protective barrier that extends from the first level 210 to the foundation 250 of a building.

Referring again to FIG. 10, the second board 116 and the fourth board 122 can also extend through a second floor board area 258 to the second floor 260 of the building. In some non-limiting embodiments, the first panel 110 and second panel 118 of the wall system 100 also include wood sheets 150, 160 (shown in FIG. 6) or wood sheets 164, 166, 190, 192 (shown in FIG. 8), respectively, that extend through the second floor board area 258 to the second floor 260 of the building. This arrangement provides a fire and sound protective barrier between different levels 210 and 260 of a building. In some examples, an additional board 117 can be mounted between the second board 116 and the fourth board 122 in the floor board area(s) 212, 258 to provide an added fire protection barrier between levels 210, 260 or between the level 260 and an attic 280.

In certain non-limiting embodiments shown in FIG. 10, the second floor 260 of the building includes a second wall system 270. The second wall system 270 can comprise any of the previously-described wall systems 100. The second wall system 270 can be the same as the first wall system 100 or, alternatively, the second wall system 270 can be different from the first wall system 100. It is appreciated that additional wall systems 100, 270 can be used to form partitions on additional floors that are found in a larger building.

As further shown in FIG. 10, the building can also include the attic 280. In order to provide fire and sound protection to the attic 280, mineral wool boards 282 can be attached to the trusses 284 found in the attic 280. As used herein, a "truss" refers to the framework or structure that supports the roof of a building. A truss is typically formed with rafters or posts. Thus, mineral wool boards 282 can be attached to the components that form the trusses in order to provide a fire and sound barrier in the attic 280 of a building. The mineral wool boards 282 can be attached to both sides of each truss 284 found in an attic 280. Alternatively, the mineral wool boards 282 can be attached to only one side of each truss 284.

Figure 11:
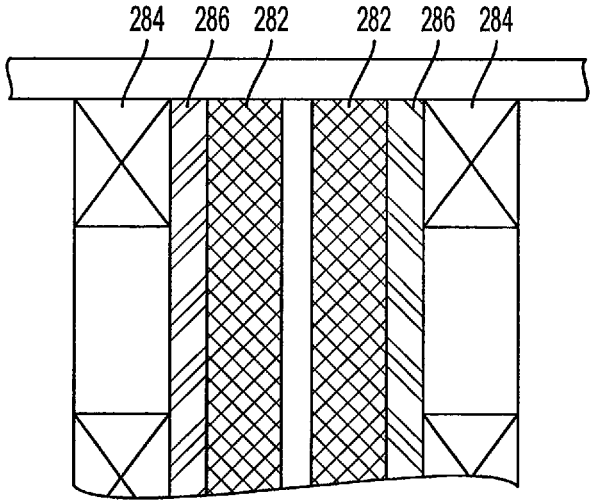
FIG. 11 is a schematic partial cross-sectional view of wood sheets and mineral wool boards attached to trusses according to the present invention.
Figure 12:
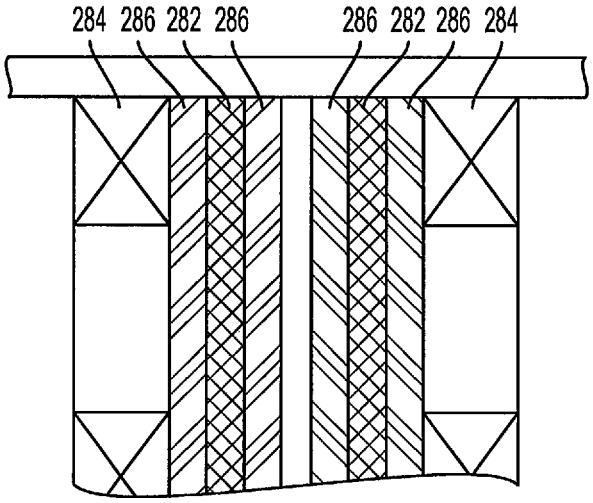
FIG. 12 is a schematic partial cross-sectional view of different layers of wood sheets and mineral wool boards attached to trusses according to the present invention.

In certain non-limiting embodiments, as shown in FIG. 11, a combination of mineral wool boards 282 and wood sheets 286 can be attached to one or both sides of each truss 284. In some examples, additional boards (e.g., 2×4 boards) can be mounted to the truss(es) 284 to form a wood frame wall extending into the attic. In some examples, a wood sheet 286, such as a wood sheet 286 with a fire-resistant coating as previously described, is positioned between the truss(es) 284 and/or wood frame wall and the mineral wool board 282. In another non-limiting embodiment shown in FIG. 12, a second wood sheet 286 is positioned on the opposite side of the mineral wool board 282 such that the mineral wool board 282 is positioned between two wood sheets 286. The mineral wool boards 282 and wood sheets 286 can also be placed in other areas of the attic 280. For instance, wood sheets 286 with fire-resistant coatings can placed over the ceiling of the attic 280 to provide additional fire and sound protection.

Thus, the previously described wall systems 100, 270, mineral wool boards 282, and optional wood sheets 286 with fire-resistant coatings can be placed throughout a building to form a continuous fire and sound resistance barrier that extends from the foundation 250 to the attic 280 of the building. In addition to possessing the superior fire and sound resistant properties, the wall systems 100, 270 according to the present invention do not absorb or deteriorate from water/moisture and, therefore, overcome the drawbacks typically encountered with currently known wall systems. Further, the combination of mineral wool boards 282 and batting material 112, 119 help slow down air movement, thereby increasing the energy efficiency of a building.

Whereas particular embodiments of this invention have been described above for purposes of illustration, it will be evident to those skilled in the art that numerous variations of the details of the present invention may be made without departing from the invention.

The invention claimed is:

1. A wall system for a building having a first room and a second room, comprising:

(a) a first panel comprising: a first batting material positioned between a first board and a second board; and (b) a second panel comprising a second batting material positioned between a third board and a fourth board, wherein the fourth board of the second panel faces the second board of the first panel, the first board of the first panel faces an interior of a first room, the third board of the second panel faces an interior of a second room, and wherein the second board and the fourth board both comprise mineral wool boards comprises at least one mineral wool board, wherein a gap is positioned between the first panel and the second panel, the gap forming an open space between the first panel and the second panel, wherein studs formed from lumber are embedded within the first batting material of the first panel and the second batting material of the second panel such that end portions of the studs extend vertically within a thickness of the first and second batting materials, and wherein the first board is attached directly to a first side of at least two studs that extend vertically within the thickness of the first batting material and the second board is attached directly to a second side of the at least two studs that extend vertically within the thickness of the first batting material, and wherein the third board is attached directly to a first side of at least two studs that extend vertically within the thickness of the second batting material and the fourth board is attached directly to a second side of the at least two studs that extend vertically within the thickness of the second batting material.

2. The wall system according to claim 1, wherein the mineral wool board comprises a binder and inorganic fibers.

3. The wall system according to claim 2, wherein the inorganic fibers are derived from stone, slag, glass, or a combination thereof.

4. The wall system according to claim 1, wherein the first board and the third board comprise a drywall/gypsum board, a mineral wool board, or a combination thereof.

5. The wall system according to claim 1, wherein at least one of the first batting material and the second batting material comprises mineral wool fibers.

6. The wall system according to claim 5, wherein an additional mineral wool board is positioned within a portion of the gap.

7. The wall system according to claim 1, wherein at least one of the second board and the fourth board independently comprises two or more mineral wool boards.

8. The wall system according to claim 1, further comprising a fire-resistant coating layer that comprises a binder comprising inorganic materials.

9. The wall system according to claim 1, wherein at least the first panel further comprises a first wood sheet positioned between the first batting material and the second board, a second wood sheet positioned on a side of the second board opposite the first wood sheet, and a fire-resistant coating layer applied over at least a portion of at least one side of the first and second wood sheets, and wherein the first wood sheet is attached to the second side of the stud that extends vertically within the thickness of the first batting material.

10. The wall system according to claim 1, wherein a length of the studs that extends vertically through the first and second batting materials insulating member is longer than the width of the studs that extends horizontally through the first and second batting materials insulating member and which are attached to the first, second, third, or fourth boards.

* * * * *